United States Patent [19]

Engelhardt et al.

[11] 3,973,742

[45] Aug. 10, 1976

[54] SELF-CENTERING COIL HOLDER

[75] Inventors: Dietmar Engelhardt, Monchen-Gladbach; Hans Raasch, Rheydt, both of Germany

[73] Assignee: W. Schlafhorst & Co., Monchen-Gladback, Germany

[22] Filed: Jan. 8, 1975

[21] Appl. No.: 539,423

[30] Foreign Application Priority Data

Jan. 9, 1974 Germany ..... 2400853

[52] U.S. Cl. ..... 242/129; 242/63

[51] Int. Cl.[2] ..... B65H 49/00; B65H 75/22

[58] Field of Search ..... 242/129, 129.8, 62, 242/63; 279/110, 119; 269/47, 52; 314/68

[56] References Cited

UNITED STATES PATENTS

| | | | |
|---|---|---|---|
| 3,326,495 | 6/1967 | DeBruyn | 242/129 |
| 3,395,308 | 7/1968 | Meyer | 314/68 |
| 3,584,809 | 6/1971 | Ogden, Sr. | 242/129 |

*Primary Examiner*—Leonard D. Christian
*Attorney, Agent, or Firm*—Herbert L. Lerner

[57] ABSTRACT

Self-centering holder for hollow textile coils of varied lengths and diameters includes at least two rod-shaped substantially parallel-extending centering and clamping members, and means includes support and adjusting members for the centering and clamping members, the at least two centering and clamping members being mounted on the support and adjusting members and being respectively pivotable into a position wherein a hollow textile coil of given diameter is receivable over the centering and clamping members collectively and wherein the latter are in pressing engagement with the inner surface of the hollow textile coil, the support and adjusting members being located outside the hollow textile coil when the latter is received on the centering and clamping members.

3 Claims, 4 Drawing Figures

SELF-CENTERING COIL HOLDER

The invention relates to a self-centering coil holder and, more particularly to an automatically centering holder device for textile coils of varied lengths and diameters, preferably spinning cops or the like, with centering and clamping means pressing against the inner surface of the hollow cores of the textile coils.

Coil holders of this general type have as their objective the bringing of the coil cores, especially for spinning cops or the like which are found in a variety of forms and dimensions on the market, into a correct position for unwinding thereof and to rapidly release the cores when they are empty or fully unwound.

In such a case, for trouble-free centering, it is of primary importance, and in fact as much as possible without time-consuming exchange of parts, to clamp the coil core in such a manner that the central axis thereof is aligned with the inlet eye.

Devices of the general type of this invention for cylindrical and conical coils are known that are operated manually with the aid of radially displaceable clamping parts. Correspondingly formed segments are pressed, in other embodiments, also by spring action against the coil core wall. A common characteristic of all of these heretofore known devices is that the clamping members of the holding means are of disc - or star-shaped construction and that they, without exception, require too much space to be able to be accommodated in cores of smaller diameter. Other heretofore known embodiments that have been used for a long time exhibit to a great extent a susceptibility to trouble with respect to dust or other deposits, or other mechanical faults appear. The objective of a concentric clamping of the coil cores is chiefly attained by the provision of three radially spreadable clamping jaws.

It is accordingly an object of the invention, while avoiding the faults of heretofore known coil holders, to provide such a device with a disposition and operation of all of the parts thereof mechanically and kinematically so that, through a spatial separation of the operating and holder members from the clamping and centering means per se, which is attained in this manner, a structural accommodation or adjustment is imparted as requires the reception of cop cores which vary markedly in shape and dimensions, in fact down to minimal diameters.

With the foregoing and other objects in view, there is provided, in accordance with the invention, a self-centering holder for hollow textile coils of varied lengths and diameters comprising at least two rod-shaped, substantially parallel-extending centering and clamping members, and means comprising support and adjusting members for the centering and clamping members, the at least two centering and clamping members being mounted on the support and adjusting members and being respectively pivotable into a positon wherein a hollow textile coil or given diameter is receivable over the centering and clamping members collectively and wherein the latter are in pressing engagement with the inner surface of the hollow textile coil, the support and adjusting member being located outside the hollow textile coil when the latter is received on the centering and clamping members.

In accordance with another feature of the invention, the at least two centering and clamping members are pivotable into an inner end position (ejection position) wherein they are located on an imaginary circle having a minimal diameter equal to or less than the smallest possible inner diameter of the hollow textile coil.

In accordance with an additional feature of the invention, the self-centering holder includes a base plate, respective linkages for the centering and clamping members, the linkages being pivotally mounted on one end thereof, respectively, on the base plate and having a free end whereon a respective one of the rod-shaped clamping and centering members is mounted, central control disc means, and coupling means, respectively, connecting each of the linkages to the control disc means.

In accordance with a further feature of the invention, the self-centering holder also comprises rotating eccentric disc means, lever means carrying a roller follower, torsion spring means biasing the lever means into a position wherein the roller follower rolls on the rotatable eccentric disc means, the lever means cooperating with the support and adjusting means for forcibly bringing the centering and clamping means, in response to the rotating eccentric disc means, into end positions wherein they are disposed on respective circles having minimum and maximum diameters.

In accordance with an added feature of the invention, which assures form-locking clamping also of conical coil cores, there are provided means comprising respective hinge pins for mounting the centering and clamping members on the support and adjusting members so as to be pivotable inwardly to a position of limited inclination so as to accommodate thereon a textile coil having a hollow conical core, and spring means biasing the pivotable centering and clamping members in direction to a position thereof wherein they are substantially parallel to one another.

Other features which are considered as characteristic for the invention are set forth in the appended claims.

Although the invention is illustrated and described herein as embodied in self-centering coil-holder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
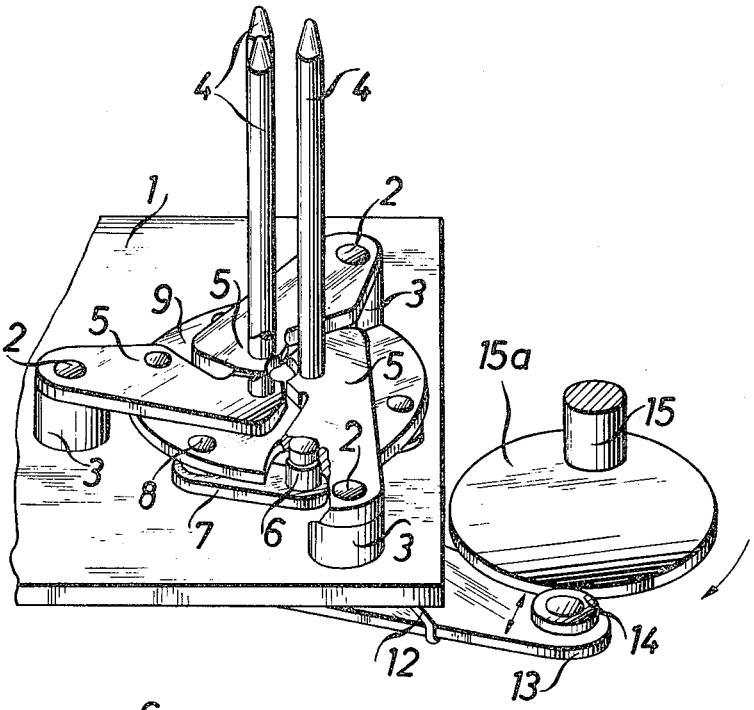
FIG. 1 is a perspective view of the automatically centering holder for yarn coils according to the invention showing the centering and clamping means thereof situated for accommodating coils of minimum diameter (ejection position)

Referring now to the drawing and first, particularly, to FIG. 1 thereof, there is shown a base plate 1 which carries nonreleasably fastened pins 2 whereon respective bushings 3 are slidingly seated. Respective pivot levers or linkages 5, whereon clamping mandrels 4 are mounted, are connected to each of the bushings 3. The respective pivot levers 5 are also connected by pins to one end of a couple 7, the other end of which being connected, in turn, to a rotary disc 9. The rotary disc 9 is welded to a pin 10 which is rotatably mounted in a bushing 11 which is press-fitted in a base plate 1. The free end of the pin 10 carries a lever 13, which is biased by a torsion spring 12 and which, in turn, carries a roller or follower 14 which rolls on the periphery of an eccentric disc 15*a* that is driven by a shaft 15 on which it is mounted.

Figure 3:
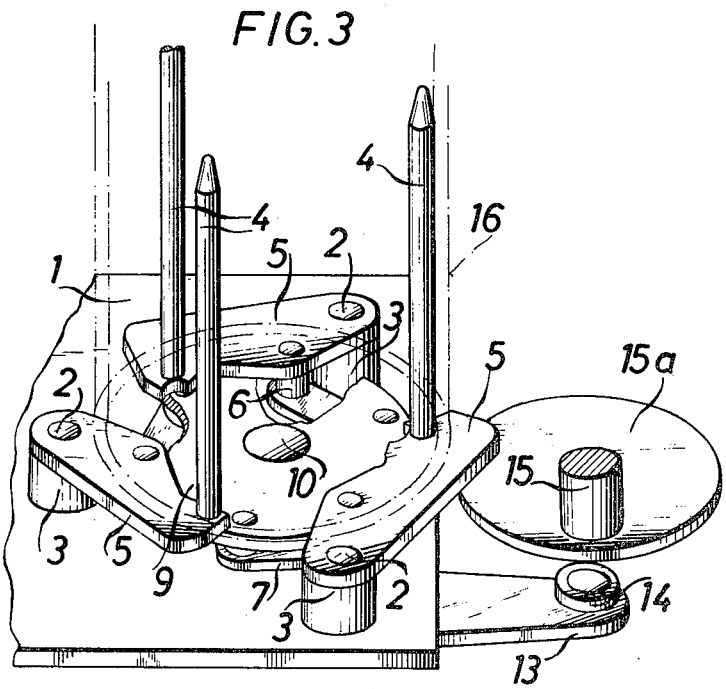
FIG. 3 is a view similar to that of FIG. 1 but showing the centering and clamping means of the automatically centering holder situated for accommodating coils of maximum diameter.

In this manner, the clamping mandrels 4 are able to be brought from the ejection position with minimal diameter illustrated in FIG. 1 to an operating position firmly clamping the cop core 16 as shown in FIG. 3. Naturally, between both of the limiting positions of FIGS. 1 and 3, an adjustment to any desirable diameter is possible. The spring 12 assures that the lever 13 necessarily follows the movements of the eccentric 15*a* so that the clamping mandrels 4 are radially displaced in a horizontal plane due to the inherent kinematics of the adjusting members 5, 7 and 9, and can firmly clamp the cop core 16.

Figure 2:
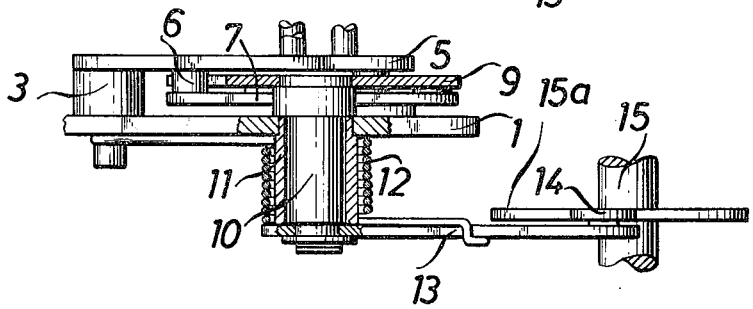
FIG. 2 is a side elevational view, partly in section and partly broken away, of the device of FIG. 1.

In FIG. 2, the individual displaceable members of the device of the invention are shown partly in section. It is apparent from FIG. 2, that the spreading of the clamping mandrels 4 is realized as a result of relative displacement of the adjusting members 5, 7 and 9 disposed in three planes.

Figure 4:
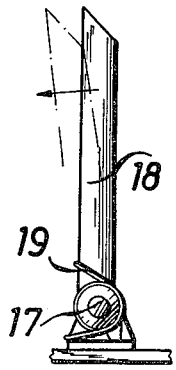
FIG. 4 is a fragmentary elevational view of a modified form of the invention of FIG. 1 showing a swingable or pivotable mounting or bearing which affords yielding or inclination of the centering and clamping means.

In FIG. 4, there is shown a modification in the embodiment of the invention of FIG. 1 according to which clamping mandrels 18 mounted so as to be pivotable about hinge pins 17, that are carried by the respective linkages 5, can be inclined inwardly and can consequently be brought into engagement with the inner wall surfaces of conical cop cores without difficulty. The normal or usual position of the clamping mandrels 18 shown by the solid lines in FIG. 4 is ensured by a strong clamping torsion spring 19.

There is claimed:

1. Self-centering holder for hollow textile coils of varied lengths and diameters comprising at least two rod-shaped, substantially parallel-extending centering and clamping members, means comprising support and adjusting members for said centering and clamping members, said at least two centering and clamping members being mounted on said support and adjusting members and being respectively pivotable into a position wherein a hollow textile coil of given diameter is receivable over said centering and clamping members collectively and wherein the latter are in pressing engagement with the inner surface of the hollow textile coil, said support and adjusting members being located outside the hollow textile coil when the latter is received on said centering and clamping members, and further including a base plate, respective linkages for said centering and clamping members, said linkage being pivotally mounted at one end thereof, respectively, on said base plate and having a free end whereon a respective one of said rod-shaped clamping and centering members is mounted, central control disc means, and coupling means, respectively, connecting each of said linkages to said control disc means.

2. Self-centering holder for hollow textile coils of varied lengths and diameters comprising at least two rod-shaped, substantially parallel-extending centering and clamping members, means comprising support and adjusting members for said centering and clamping members, said at least two centering and clamping members being mounted on said support and adjusting members and being respectively pivotable into a position wherein a hollow textile coil of given diameter is receivable over said centering and clamping members collectively and wherein the latter are in pressing engagement with the inner surface of the hollow textile coil, said support and adjusting members being located outside the hollow textile coil when the latter is received on said centering and clamping members, and further comprising rotating eccentric disc means, lever means carrying a roller follower, torsion spring means biasing said lever means into a position whereby said roller follower rolls on said rotatable eccentric disc means, said lever means cooperating with said support and adjusting means for forcibly bringing said centering and clamping means, in response to said rotating eccentric disc means, into end positions wherein they are disposed on respective circles having minimum and maximum diameters.

3. Self-centering holder for hollow textile coils of varied lengths and diameters and having substantially conical cores comprising at least two rod-shaped, substantially parallel-extending centering and clamping members, means comprising support and adjusting members for said centering and clamping members, said at least two centering and clamping members being mounted on said support and adjusting members and being respectively pivotable into a position wherein a hollow textile coil of given diameter is receivable over said centering and clamping members collectively and wherein the latter are in pressing engagement with the inner surface of the hollow textile coil, said support and adjusting members being located outside the hollow textile coil when the latter is received on said centering and clamping members, and further including means comprising respective hinge pins for mounting said centering and clamping members on said support and adjusting members so as to be pivotable inwardly to a position of limited inclination so as to accommodate thereon a textile coil having a hollow conical core, and spring means biasing said pivotable centering and clamping members in direction to a position thereof wherein they are substantially parallel to one another.

* * * * *